US005756646A

United States Patent [19]

Nasu et al.

[11] Patent Number: 5,756,646

[45] Date of Patent: May 26, 1998

[54] AGENT FOR IMPROVING SURFACE QUALITY OF PAPER

[75] Inventors: Kenji Nasu; Hiroharu Kawano; Satoshi Takizawa; Kiyoshi Iwai, all of Chiba-ken, Japan

[73] Assignee: Japan PMC Corporation, Japan

[21] Appl. No.: 616,278

[22] Filed: Mar. 15, 1996

[30] Foreign Application Priority Data

Mar. 17, 1995 [JP] Japan ..... 7-084631

[51] Int. Cl.[6] ..... C08G 69/08

[52] U.S. Cl. ..... 528/310; 528/315; 528/332; 528/367; 528/422; 525/329.4

[58] Field of Search ..... 528/310, 315, 528/332, 367, 422; 525/329.4

[56] References Cited

FOREIGN PATENT DOCUMENTS

| | | | |
|---|---|---|---|
| 43-27529 | 11/1968 | Japan . | |
| 44-8743 | 4/1969 | Japan . | |
| 52-24295 | 2/1977 | Japan . | |
| 53-59787 | 5/1978 | Japan . | |
| 59-94699 | 5/1984 | Japan . | |
| 5302298 | 11/1993 | Japan . | |
| 1045229 | 10/1966 | United Kingdom | C08F 15/00 |

OTHER PUBLICATIONS

Microstructure of acrylamide–acrylic acid copolymers: 2. As obtained by direct copolymerization *Polymer*, 1986, vol. 27, Mar., pp. 467–475.

Microstructure of acrylamide–acrylic acid copolymers: 1. As obtained by alkaline hydrolysis *Polymer*, 1986, vol. 37, Mar., pp. 459–466.

Translation of relevant parts of Japanese Laid–Open Patent Publication No. Sho 53–59787, entitled "Process for Producting Copolymers".

*Primary Examiner*—Duc Truong

*Attorney, Agent, or Firm*—Webb Ziesenheim Bruening Logsdon Orkin & Hanson, P.C.

[57] ABSTRACT

An agent for improving surface quality of paper comrising an acrylamide resin composition obtained by hydrolyzing an acrylamide resin which is obtained by polymerizing an acrylamide monomer in the presence of a urea compound, or copolymerizing an acrylamide monomer and an acrylonitrile monomer; an acrylamide monomer and a cross-linking agent; or an acrylamide monomer, an acrylnitrile monomer and a cross-linking agent in the presence of a urea compound. This agent provides paper with excellent surface strength, tensile strength and internal strength far better than conventional paper quality improving agents.

19 Claims, No Drawings

AGENT FOR IMPROVING SURFACE QUALITY OF PAPER

FIELD OF THE INVENTION

The present invention relates to an agent for improving surface quality of paper.

More particularly, the invention relates to an agent for improving surface strength (cohesiveness), tensile strength and internal strength (cohesiveness) of paper and especially reducing formation of pickings caused during printing, said agent containing an acrylamide resin composition.

BACKGROUND OF THE INVENTION

As agents for improving surface quality of paper, printability, etc., natural and synthesized water-soluble polymers including starch and modified starch such as oxidized starch, cationized starch, enzyme-modified starch, etc.; cellulose derivatives such as carboxymethyl cellulose; water-soluble polymers such as polyvinyl alcohol (PVA), anionic acrylamide resins, etc. have been used. Among these, inexpensive starch derivatives are most widely used. However, starch derivatives and PVA must be cooked for dissolving when used, and thus the handling thereof is not easy and involve some troubles such as foaming in the coating operation. The starches suffer from putrefaction and aging. Therefore, anionic polyacrylamide resins are nowadays more widely used as paper-surface improving agents for newsprint paper, woodfree paper and other various papers, replacing starch derivative and PVA.

As the above-described anionic polyacrylamide resins, water-soluble polymers, which are obtained by copolymerizing, in water, (meth)acrylamide and monomers having considerable solubility in water such as acrylic or methacrylic acid by ordinary radical reaction, can be referred to, and they are proposed as surface strength improving agents for paper Japanese Patent Publication No. Sho 43-27529). However, their effect of improving surface strength cannot be said to be sufficient.

There is known a paper-strength-improving agent obtained by reacting copolymers, which are obtained by copolymerizing an α,β-unsaturated amide, an α,β-unsaturated nitrile and a nonionic monomer and allowing to react the resulting copolymer in an alkaline aqueous solution Japanese (Laid-open Patent Publication No. Sho 59-94699). But this is an internal additive and it does not exhibit sufficient effect of improving surface strength, tensile strength and internal strength when it is used externally as in the case of this invention.

An acrylamide resin, which is obtained by copolymerizing an acrylamide, an α, β-unsaturated monocarboxylic acid, an α,β-unsaturated dicarboxylic acid and an unsaturated sulfonic acid or salts thereof as essential components in the presence of a urea compound, was proposed as a surface quality improving agent for paper Japanese (Laid-Open Patent Publication No. Hei 5-302298). However, this resin cannot be said to bo so sufficient in improvement of surface strength.

Recently, demand for further improvement of paper surface quality has risen and known paper quality improving agents now do not satisfy the need, and occurrence of troubles in printing caused by insufficient surface strength of paper has increased.

Especially, nowadays newspaper, etc. are mainly printed by offset printing and formation of pickings in printing is a problem. Therefore, surface strength of paper is improved by coating the paper surface with a starch derivative, PVA or conventional acrylamide resins by means of a gate roll coater, etc. in the case of newsprint paper, etc.

Although paper coated with water-soluble polymer has, improved surface strength, the paper surface is remarkably tackified by water which is applied on the surface for wetting in the printing stage and thus rather increases formation of pickings. Under the circumstances, an excellent surface quality improving agent is desired for improving surface strength of paper in order to reduce the formation of pickings during printing of newspaper, etc.

The task of the present invention is to meet this demand and is to provide a surface-quality-improving agent for paper which improves surface strength, internal strength as well as tensile strength of paper and reduces formation of pickings in printing.

SUMMARY OF THE INVENTION

The present invention comprises an agent for improving surface quality of paper comprising an acrylamide resin composition obtained by hydrolyzing an acrylamide resin which is obtained by polymerizing an acrylamide monomer in the presence of a urea compound, or copolymerizing an acrylamide monomer and an acrylonitrile monomer; an acrylamide monomer and a cross-linking agent; or an acrylamide monomer, an acrylonitrile monomer and a cross-linking agent in the presence of a urea compound. This agent provides paper with excellent surface strength, tensile strength and internal strength far better than conventional paper quality improving agents.

DETAILED DESCRIPTION OF THE INVENTION

We conducted intensive research in order to solve the above-described problems. We have found that excellent effect for improving surface strength, tensile strength and internal strength of paper is exhibited by a paper surface quality improving agent comprising an acrylamide resin composition, which is obtained by polymerizing an acrylamide monomer alone; copolymerizing an acrylamide monomer and an acrylonitrile monomer; an acrylamide monomer and a cross-linking agent; or an acrylamide monomer, an acrylonitrile monomer and a cross-linking agent, in the presence of a urea compound and hydrolyzing the resulting acrylamide resin and completed this invention.

That is, the present invention provides a paper surface quality improving agent comprising an acrylamide resin composition obtained by polymerizing, in the presence of a urea compound, an acrylamide monomer alone, or copolymerizing 99.5–50 mol % of acrylamide monomer and 0.5–50 mol % of an acrylonitrile monomer; an acrylamide monomer and 0.005–5 mol % of the acrylamide monomer of a cross-linking agent; or 99.5–50 mol % of an acrylamide monomer, 0.5–50 mol % of an acrylonitrile monomer and 0.005–5 mol % of the total of the acrylamide monomer and the acrylonitrile monomer of a cross linking agent, said acrylamide resin being hydrolyzed by adding 1–40 mol % of the total of the acrylamide monomer and the acrylonitrile monomer of a hydrolyzing agent, wherein the ratio of the monomers which constitute the acrylamide resin to the urea compound is 95–40 wt %:5–60 wt %, preferably 95–60 wt %:5–40 wt %, more preferably 95–70 wt %:5–30 wt %.

The acrylamide resin composition of the present invention is obtained by polymerizing, in the presence of a urea compound, an acrylamide monomer alone, or copolymerizing an acrylamide monomer and an acrylonitrile monomer;

copolymerizing an acrylamide monomer and a cross-linking agent; or copolymerizing an acrylamide monomer, an acrylonitrile monomer and a cross-linking agent, and hydrolyzing the carbamoyl groups or the cyano groups of the thus obtained acrylamide resin to convert them to carboxyl groups, which are anionic. It is surmised that this acrylamide resin composition forms a sequence different from that of the conventional acrylamide resins, which are obtained by copolymerization of a monomer having an intramolecular carboxyl group such as acrylic acid and acrylamide. It is considered that, because of the difference in the sequence, the acrylamide resin composition of the present invention exhibits improved surface strength, tensile strength and internal strength which are not achieved by the conventional anionic acrylamide resins.

The urea compounds used in the present invention include urea, thiourea, ethylene urea, ethylene thiourea, etc. One or more of these can be used in combination. It is especially economically preferable to use urea alone.

As acrylamide monomers, in addition to acrylamide and methacrylamide, N-substituted (meth)acrylamide such as N-methyl(meth)acrylamide, N-ethyl(meth)acrylamide, N,N-dimethyl(meth)acrylamide, N-isopropyl(meth) acrylamide, N-t-octyl(meth)acrylamide, etc. can be referred to. One or more thereof can be used.

As acrylonitrile monomers, specifically acrylonitrile, methacryl nitrile, etc. can be referred to and one or more of them can be used in combination.

As cross-linking agents, di(meth)acrylates such as ethyleneglycol di(meth)acrylate, diethyleneglycol di(meth)acrylate, triethyleneglycol di(meth)acrylate, propyleneglycol di(meth)acrylate, etc.; bis(meth)acrylamides such as methylene-bis(meth)acrylamide, ethylene-bis(meth) acrylamide, hexamethylene-bis(meth)acrylamide, N,N'-bis-acrylamide acetic acid, N,N'-bis-acrylamide methyl acetate, N,N-benzylidene-bis-acrylamide, etc.; divinyl esters such as divinyl adipate, divinyl sebacate, etc.; epoxy acrylates; urethane acrylates; bifunctional vinyl monomers such as allyl (meth)acrylate, diallyl phthalate, diallyl maleate, diallyl succinate, diallyl acrylamide, divinylbenzene, diisopropylbenzene, diallylamine, N,N-diallylmethacrylamide, N-methylolacrylamide, diallyldimethylammonium, diallyl chlorendate, glycidyl (meth)acrylate, etc. can be referred to.

As cross-linking agents, also trifunctional vinyl monomers such as 1,3,5-triacryloylhexahydro-S-triazine, triallylisocyanurate, N,N-diallylacrylamide, triallylamine, triallyl trimellitate, etc.; tetrafunctional vinyl monomers such as tetramethylolmethane tetraacrylate, tetraallyl pyromellitate, N, N, N', N'-tetraallyl-1,4-diaminobutane, tetraallylamine salt, tetraallyloxyethane, etc.; water-soluble aziridinyl compounds such as tetramethylolmethane tri-β-aziridinyl propionate, trimethylolpropane-tri-β-azirizinyl propionate, 4,4'-bis(ethyleneiminecarbonylamino) diphenylmethane, etc.; water-soluble polyfunctional epoxy compounds such as (poly)ethyleneglycol diglycidylether, (poly)propyleneglycoldiglycidylether, (poly) propyleglycoldiglycidylether, (poly)glycerine diglycidy (poly)propyleneglycoldiglycidylether, (poly)glycerine triglycidyl ether, etc. can be used.

As cross-linking agents, further silicone compounds such as 3-(meth)acryloxymethyltrimethoxysilane, 3-(meth) acryloxypropyldimethoxymethylsilane, 3-(meth) acryloxypropyltrimethoxysilane, etc. can be used.

In addition to the acrylamide monomers, acrylonitrile monomers and cross-linking agents, other copolymerizable anionic vinyl monomers, cationic vinyl monomers and nonionic vinyl monomers can be employed insofar as they do not impair performances of the resulting acrylamide resin. These can be used in combination of two or more.

As anionic vinyl monomers, α,β-unsaturated monocarboxylic acids such as acrylic acid, methacrylic acid, etc. and alkali metal salts thereof such as sodium salt, potassium salt and ammonium salt thereof; α,β-unsaturated dicarboxylic acids such as maleic acid, fumaric acid, itaconic acid, citraconic acid, etc., and alkali metal salts thereof such as sodium salt, potassium salt, etc., as well as ammonium salt thereof; α,β-unsaturated tricarboxylic acid such as aconitic acid, 3-butene-1,2,3-tricarboxylic acid, 4-pentene-1,2,4-tricarboxylic acid, etc. and alkali metal salts thereof such as sodium salt, potassium salt, etc. and ammonium salt thereof; organic sulfonic acids such as vinylsulfonic acid, styrenesulfonic acid, 2-acrylamide-2-methyl-propanesulfonic acid, etc. and alkali metal salts thereof such as sodium salt, potassium salt, etc. and ammonium salt thereof; and phosphonic acids such as vinylphosphonic acid, α-phenylvinylphosphonic acid and alkali metal salts thereof such as sodium salt, potassium salt, etc. and ammonium salt thereof can be used. These monomers can be used in combination of two or more.

As cationic vinyl monomers, vinyl monomers having a tertiary amino group, a secondary amino group or a primary amino group such as dimethylaminoethyl (meth)acrylate, diethylaminoethyl (meth)acrylate, dimethylaminopropyl (meth)acrylate, diethylaminopropyl(meth)acrylate, dimethylaminopropyl(meth)acrylamide or diethylaminopropyl(meth)acrylamide, alkyldiallylamine, dialkylallylamine, allylamine, diallylamine, etc. and their salts of inorganic acids such as hydrochloric acid, sulfuric acid, etc. and organic acids such as formic acid, acetic acid etc. can be used.

Also vinyl monomers containing a quaternary ammonium salt, which is obtained by reaction of one of said tertiary amino group-containing vinyl monomers and a quaternizing agent of a group including an alkyl halide such as methyl chloride, methyl bromide, etc.; an arylalkyl halide such as benzyl chloride, benzyl bromide, dimethyl sulfate, diethyl sulfate, epichlorohydrin, 3-chloro-2-hydroxypropyltrimethylammonium chloride, glycidyltrialkylammonium chloride, etc., whose example is 2-hydroxy-N,N,N,N',N'-pentamethyl-N'-[3-{(1-oxo-2-propenyl)amino}propyl]-1,3-propanediaminium dichloride, can be referred to and two or more of these can be used in combination.

As nonionic vinyl monomers, esters of an alcohol and a (meth)acrylic acid; styrene, styrene derivatives, vinyl acetate, vinyl propionate, methylvinylether, etc. can be referred to and two or more of them can be used in combination.

Preparation of the acrylamide resin can be carried out as follows. Monomer components and a urea compound which constitute the acrylamide resin are placed in a suitable reaction vessel together with necessary solvent in a total amount of 2–50 wt %, preferably 5–30 wt %, more preferably 10–30 wt % in concentration and polymerization is effected using a conventional polymerization initiator at a temperature of 40°–100° C. for a period of 0.5–10 hours. Needless to say, monomers can be added dropwise or in installments depending upon the characteristics of the used components.

Usually water is used as a solvent. However, lower alcohols such methanol, ethanol, propnaol, butanol, etc. can be added to assist dissolution.

The urea compounds are used in an amount that the ratio of the amounts of the urea compound and the monomers which constitute the acrylamide resin is 95–40%:5–60%, preferably 95–60%:5–40%, more preferably 95–70%:5–30%. With a urea compound in an amount of not more than 5 wt % or in excess of 60 wt %, the effect of improving surface strength, tensile strength as well as internal strength is not sufficient.

The acrylonitrile monomers are used in an amount that the ratio of the acrylamide monomer and the acrylnitrile monomer is 99.5–50 mol %:0.5–50 mol %, preferably 95–70 mol %:5–30 mol %, more preferably 95–80 mol %:5–20 mol %. With an acrylonitrile in an amount of not more than 0.5 mol %, the effect of the resulting acrylamide resin to improve surface strength, tensile strength as well as internal strength is insufficient and with an acrylnitrile in an amount of in excess of 50 mol %, the resulting acrylamide resin is water-insoluble.

The cross-linking agent is used in an amount of 0.005–5 mol %, preferably 0.01–2 mol % and more preferably 0.01–1 mol % of the total amount of the monomers which constitute the acrylamide resin.

For polymerization, known conventional polymerization initiators can be used. Examples thereof are sodium persulfate, potassium persulfate, ammonium persulfate; peroxides such as benzoyl peroxide, tert-butyl hydroperoxide, di-tert-butyl peroxide, etc.; bromic acid salts such as sodium bromate, potassium bromate, etc.; perborate salts such as sodium perborate, potassium perborate, ammonium perborate, etc.; percarbonate salts such as sodium percarbonate, potassium percarbonate, ammonium percarbonate, perphosphoric acid salts such as sodium perphosphate, potassium perphosphate, ammonium perphosphate, etc. These initiators can be used singly but they can be used as a redox catalyst in combination with a reducing agent. As reducing agents, sulfite salts, hydrogen sulfite salts, organic amines such as N,N,N',N'-tetramethylethylenediamine; azo compounds such as hydrochloric acid salt of 2,2'-azo-bis-2-amidinopropane, etc.; reducing sugar such as aldose, etc. can be referred to.

Azo compounds such as azo-bis-isobutyronitrile, 2,2'-azo-bis-2-amidinopropane bydrochloride, 2,2'-azo-bis-2,4-dimethyl-valeronitrile, 4,4'-azo-bis-4-cyano-valeric acid or salts thereof can be used. More than one initiator can be used in combination. Usually the polymerization initiator is used in an amount of 0.005–5 mol %, preferably 0.01–2 mol % of the total amount of the monomers which constitute the acrylamide resin.

Conventional chain transfer agents can be used as required. For instance, allyl compounds such as allyl alcohol, allyl amine etc.; mercaptoethanol; thioglycollic acid or alkali metal salts or ammonium salt thereof; isopropyl alcohol, sodium hypophosphite, etc. can be used.

As hydrolyzing agents, alkali metal hyroxides such as sodium hydroxide, potassium hydroxide, lithium hydroxide, etc.; alkali metal carbonates such as sodium carbonate, potassium carbonate, lithium carbonate, etc.; ammonia; amine bases such as methylamine, dimethylamine, trimethylamine, diethylamine, etc.; or inorganic acids such as sulfuric acid, hydrochloric acid, nitric acid, phosphoric acid, etc.; and organic acids such as formic acid, acetic acid, propionic acid, methylsulfuric acid, etc. can be used. Among these, the most efficient hydrolysis of the acrylamide resin is achieved when sodium hydroxide or potassium hydroxide is used.

The hydrolyzing agent is preferably added to the reaction mixture after the polymerization ceases, or when a conversion of 95 mol % was reached if shorter reaction time is desired. If the hydrolyzing agent is added at the point when less than 95 mol % of conversion was reached, side reactions are caused and the effect of the resulting acrylamide resin composition to improve surface strength, tensile strength and internal strength is inferior.

The hydrolyzing agent is added in an amount of 1–40 mol %, preferably 5–30 mol % of the total amount of the acrylamide monomers and the acrylonitrile monomers. The reaction is conducted at a temperature of 40°–100° C. for 0.1–20 hours. When the hydrolyzing agent is used in an amount of not more than 1 mol %, a sufficient amount of anionic groups are not introduced into the acrylamide resin and thus satisfactory effect to improve surface strength, tensile strength and internal strength of paper is not achieved. When the hydrolyzing agent is used in an amount of not less than 40 mol %, hydrolysis is not correspondingly promoted, i.e., the reaction efficiency is poor. With the reaction time of not more than 0.1 hour, sufficient amount of anionic groups are not introduced and satisfactory effect of improving surface strength, tensile strength and internal strength is not achieved. Even if reaction is conducted for not less than 20 hours, introduction of anionic groups does not correspondingly increase. It is simply not economical and, therefore, undesirable.

After the acrylamide resin is hydrolyzed as described above, the pH of the reaction mixture is adjusted to 6–10, thus the hydrolysis is terminated, and the acrylamide resin composition is obtained. The surface quality improving agent for paper containing this acrylamide resin composition preferably has a viscosity of not more than 15000 cps (at 25° C.) when measured by a Brookfield rotation viscosimeter.

The paper surface quality improving agent of this invention can be used in combination with natural and synthesized water-soluble polymers including starches such as starch, oxidized starch, cationized starch; celluloses such as carboxymethyl cellulose; PVA, polyacrylamide, etc. There is no problem if it is used in combination with surface sizing agents, anti-slip agents antiseptics, defoamers, viscosity-modifiers, mold-release agents, corrosion inhibitors, anti-inflammatories, dyes, etc.

The concentration of the surface quality improving agent of the invention when it is used as a coating solution is preferably 0.1–15 wt %. The amount of the coating is suitably determined by considering the degree of sizing and other parameters.

The paper surface quality improving agent of the invention can be applied to paper and paperboard. It can be applied using size-press, film press, gate roll coater, blade coater, calendar, bar coater, knife coater, air knife coater, etc. Also it can be applied by means of spray coating.

The paper surface quality improving agent of the invention can be used for newsprint paper, coating base paper, liners, coated board, white board, antiflammatory base paper, base paper for postcard and woodfree paper as well as printing and writing paper, form paper, PPC paper, paper for ink-jet printing, heat-sensitive paper, which are made by acidic or neutral papermaking. It is applicable to base paper of any sizing degree. When it is applied by means of a size-press, it is desirable to use an internal size agent in order to adjust the pick-up of the agent by the base paper.

The paper surface quality improving agent of the invention exhibits especially excellent effect for newsprint paper and acidic woodfree paper.

Now the invention is described by way of working and comparative examples. The percentage referred to in the following examples is by weight. Needless to say, the invention is not limited to the working examples only.

EXAMPLE 1

In a one-liter four-necked flask equipped with a stirrer, a thermometer, a reflux cooler and a nitrogen-inlet tube, 341.6 g of water, 11.9 g of urea, 213.3 g of a 50% aqueous solution of acrylamide and 13.5 g of isopropyl alcohol were placed. After the oxygen in the reaction system was purged with nitrogen gas, 3.4 g of a 5% aqueous solution of ammonium persulfate and 1.8 g of a 2% solution of sodium metabisulfite were added at 45° C. The mixture was allowed to react at 80° C. for one hour. Then 60.0 g of a 20% aqueous solution of sodium hydroxide (20 mol % of the amount of acrylamide) was added and the mixture was further allowed to react at 80° C. for another hour. Thereafter, the reaction was made to stop by addition of 24.0 g of water and 65.3 g of a 20% aqueous solution of sulfuric acid and a transparent acrylamide resin composition A, whose solid content was 20.8%, viscosity was 5600 cps and pH was 6.4.

EXAMPLES 2–7 AND COMPARATIVE EXAMPLES 1–6

In the same manner as in Example 1, but varying species of

TABLE 1

COMPOSITION AND PROPERTIES OF ACRYLAMIDE REISN COMPOSITION

| | RESIN COMPO-SITION | (a) ACRYL-AMIDE (MOL %) | (b) ACRYLO-NITRILE (MOL %) | (c) CROSS-LINKER (MOL %) | (d) OTHER MONOMER (MOL %) | | MONOMER /UREA (WT %) | HYDROLYSING AGENT | | SOLIDS (%) | VIC'TY (cps, 25° C.) | pH |
|---|---|---|---|---|---|---|---|---|---|---|---|---|
| WORKING EXAMPLES | | | | | | | | | | | | |
| 1 | A | 100 | | | | | 90/10 | NaOH | 20 | 20.8 | 5600 | 6.4 |
| 2 | B | 85 | 15 | | | | 80/20 | KOH | 20 | 20.5 | 7600 | 6.3 |
| 3 | C | 95 | | | AAc | 5 | 90/10 | $H_2SO_4$ | 15 | 19.7 | 7400 | 7.7 |
| 4 | D | 95.5 | 4 | | St | 0.5 | 80/20 | NaOH | 30 | 20.6 | 5100 | 8.3 |
| 5 | E | 93 | 7 | MBAAm 0.02 | | | 60/40 | NaOH | 20 | 19.8 | 5500 | 8.0 |
| 6 | F | 88 | 10 | | | | 70/30 | NaOH | 10 | 19.7 | 4000 | 8.1 |
| 7 | G | 98 | | MBAAm 0.02 | IA | 2 | 85/15 | NaOH | 15 | 20.5 | 6800 | 8.2 |
| COM. EXAMLPES | | | | | | | | | | | | |
| 1 | H | 80 | | | AAc | 20 | 100/0 | | | 20.8 | 7400 | 7.6 |
| 2 | I | 85 | 15 | | | | 100/0 | NaOH | 20 | 21.6 | 4550 | 7.9 |
| 3 | J | 80 | | | AAc | 20 | 90/10 | | | 20.5 | 5350 | 6.4 |
| 4 | K | 100 | | | | | 100/0 | NaOH | 20 | 21.3 | 7350 | 7.9 |
| 5 | L | 75 | 20 | | MAc | 5 | 100/0 | NaOH | 20 | 20.1 | 5500 | 8.0 |
| 6 | M | 80 | 15 | | AAc | 5 | 80/20 | | | 20.7 | 6050 | 7.5 |

AAc: ACRYLIC ACID, IA: ITACONIC ACID, St: STYRENE, DM: DIMETHYLAMINOETHYL METHACRYLATE, MBAAm: METHYLENE-BIS-ACRYLAMIDE
THE NUMERALS IN THE COLUMN OF HYDROLYZING AGENT STAND FOR THE RATIO OF (a) ACRYLAMIDE AND (b) ACRYLONITRILE.

TABLE 2

EVALUATION WITH NEWSPRINT PAPER

| | | RESIN COMPOSITION | COATING WT ($g/m^2$) | DRY PICK | WET PICK | DRY BREAKING LENGTH (km) | WET BREAKING LENGTH (km) |
|---|---|---|---|---|---|---|---|
| INVENTION EXAMPLES | 1 | A | 0.07 | 10 | 10 | 6.61 | 0.95 |
| | 2 | B | 0.06 | 10 | 10 | 6.72 | 0.96 |
| | 3 | C | 0.07 | 9 | 9 | 6.59 | 094 |
| | 4 | D | 0.07 | 10 | 10 | 6.63 | 0.95 |
| | 5 | E | 0.07 | 9 | 8 | 6.58 | 0.94 |
| | 6 | F | 0.06 | 9 | 9 | 6.54 | 0.94 |
| | 7 | G | 0.07 | 10 | 9 | 6.59 | 0.94 |
| COMPARATIVE EXAMPLES | 1 | H | 0.07 | 6 | 6 | 6.33 | 0.89 |
| | 2 | I | 0.08 | 6 | 5 | 6.36 | 0.91 |
| | 3 | J | 0.07 | 7 | 6 | 6.41 | 0.92 |
| | 4 | K | 0.07 | 6 | 5 | 6.38 | 0.92 |
| | 5 | L | 0.08 | 6 | 6 | 6.31 | 0.92 |
| | 6 | M | 0.07 | 5 | 5 | 6.24 | 0.91 |
| | 7 | OXIDIZED STARCH | 0.27 | 4 | 4 | 6.18 | 0.87 |
| | 8 | PVA | 0.07 | 6 | 5 | 6.20 | 088 |
| | 9 | WATER | — | 1 | 1 | 6.04 | 0.85 |

TABLE 3

EVALUATION WITH ACIDIC WOODFREE PAPER

| | | RESIN COMPOSITION | COATING WT ($g/m^2$) | DRY PICK | WET PICK | SCOT BOND (kgf · cm) |
|---|---|---|---|---|---|---|
| INVENTION EXAMPLES | 8 | A | 0.49 | 10 | 10 | 2.78 |
| | 9 | B | 0.47 | 10 | 10 | 2.84 |
| | 10 | C | 0.50 | 10 | 10 | 2.83 |
| | 11 | D | 0.48 | 10 | 10 | 2.79 |
| | 12 | E | 0.47 | 9 | 9 | 2.75 |
| | 13 | F | 0.50 | 9 | 8 | 2.73 |
| | 14 | G | 0.48 | 10 | 9 | 2.77 |
| COMPARATIVE EXAMPLES | 10 | H | 0.48 | 6 | 5 | 2.55 |
| | 11 | I | 0.48 | 6 | 5 | 2.53 |
| | 12 | J | 0.49 | 7 | 6 | 2.70 |
| | 13 | K | 0.50 | 6 | 6 | 2.63 |
| | 14 | L | 0.48 | 5 | 6 | 2.58 |
| | 15 | M | 0.47 | 5 | 5 | 2.69 |
| | 16 | OXIDIZED STARCH | 1.02 | 4 | 3 | 2.33 |
| | 17 | PVA | 0.49 | 6 | 6 | 2.28 |
| | 18 | WATER | — | 1 | 1 | 1.67 |

TABLE 4

EVALUATION WITH NEUTRAL WOODFREE PAPER

| | | RESIN COMPOSITION | COATING WT ($g/m^2$) | DRY PICK | WET PICK | SCOT BOND (kgf · cm) |
|---|---|---|---|---|---|---|
| INVENTION EXAMPLES | 15 | A | 0.34 | 10 | 9 | 4.38 |
| | 16 | B | 0.32 | 10 | 9 | 4.46 |
| | 17 | C | 0.33 | 8 | 9 | 4.36 |
| | 18 | D | 0.34 | 9 | 9 | 4.41 |
| | 19 | E | 0.32 | 9 | 9 | 4.39 |
| | 20 | F | 0.34 | 8 | 8 | 4.34 |
| | 21 | G | 0.33 | 9 | 9 | 4.45 |
| COMPARATIVE EXAMPLES | 19 | H | 0.34 | 7 | 6 | 3.98 |
| | 20 | I | 0.33 | 7 | 6 | 4.25 |
| | 21 | J | 0.33 | 8 | 7 | 4.30 |
| | 22 | K | 0.33 | 7 | 6 | 4.15 |
| | 23 | L | 0.33 | 6 | 6 | 4.18 |
| | 24 | M | 0.34 | 7 | 7 | 4.20 |
| | 25 | OXIDIZED STARCH | 0.68 | 5 | 5 | 3.86 |
| | 26 | PVA | 0.34 | 7 | 6 | 3.78 |
| | 27 | WATER | — | 1 | 1 | 2.66 |

the monomer, the amount thereof and the monomer/urea ratio as indicated in Table 1, acrylamide resin compositions B–G (working examples) and H–M (comparative examples) were obtained.

The properties of the acrylamide resin compostions A–M obtained in Examples 1–7 and Comparative Examples 1–6 are shown in Table 1. In the table, the viscosities are values measured by means of a Brookfield viscosimeter at 25° C.

The effect of the acrylamide resin compositions obtained in the above-described Working Examples 1–7 and Comparative Examples 1–6 as well as MS-3800 (oxidized starch supplied by Nihon Shokuhin Kako Co., Ltd.) and PVA-117 (polyvinyl alcohol supplied by Kuraray Co., Ltd.) was evaluated by the methods as described below.

Surface strength

Dry pick:

RI Printing Tester, nip width 10 mm

Ink: FINE INK (for IGT printing test supplied by Dainippon Ink and Chemicals, Inc.)

T. V. of ink=24

Wet pick:

RI Printing Tester with Molton rolls, nip width 10 mm

Ink: CAPS G (supplied by Dainippon Ink and Chemicals, Inc. for offset printing)

T.V. of ink: 12

Test samples were visually observed to evaluate degree and condition of picking of printed paper. Evaluation was made according to a scale of 10, with 10 as excellent and 1 as poorest.

Internal Strength

Scot Bond (kgf·cm): was measured, using an internal bond tester (manufactured by Kumagaya Riki Kogyo K.K.), with 5 $kg/cm^2$ of adhesion pressure for 30 sec.

Tensile Strength

Dry breaking length (km): JIS P8113

Wet breaking length (km): JIS P8135

Use Examples 1–7 Evaluation with newsprint paper

A 1% solution of acrylamide resin compositions A–G obtained in Working Examples 1–7 were applied to on one side of newsprint paper of a basis weight of 43 $g/m^2$ by means of a bar coater No. 3 and the coated paper was dried in a drum dryer at 80° C. for 50 sec. The coating weight was 0.06–0.07 g solids/$m^2$. After drying, the test samples were allowed to stand in a thermohygrostat chamber of 20° C. and 65% RH. The thus treated test samples were subjected to the evaluation tests. The test results are shown in Table 2.

COMPARATIVE USE EXAMPLES 1–6

The acrylamide resin compositions H–M obtained in Comparative Examples 1–6 were applied to paper and evaluated in the same manner as in Use Examples 1–7. The coating weight of the acrylamide resin compositions was 0.07–0.08 g solids/m$^2$. The results are shown in Table 2.

COMPARATIVE USE EXAMPLE 7

The coating and evaluation test was carried out in the same manner as in Use Examples 1–7 but using a 3% solution of MS-3800 (oxidized starch supplied by Nihon Shokuhin Kako Co., Ltd.) The coating weight of oxidized starch was 0.27 g solids/m$^2$. The results are shown in Table 2.

COMPARATIVE USE EXAMPLE 8

The coating and evaluation test was carried out in the same manner as in Use Examples 1–7 but using a 1% solution of PVA-117 (polyvinyl alcohol supplied by Kuraray Co., Ltd.) The coating weight of PVA was 0.07 g solids/m$^2$. The test results are shown in Table 2.

COMPARATIVE USE EXAMPLE 9

The coating and evaluation test was carried out in the same manner as in Use Examples 1–7 but using water only. The test results are shown in Table 2.

Use Examples 8–14 (Evaluation with acidic woodfree paper)

A 3% solution of the acrylamide resin compositions A–G obtained in Working Examples 1–7 was applied to one side of acidic woodfree paper (basis weight 73 g/m$^2$) by means of a barcoater No. 3. The coated paper samples were dried in a drum dryer at 80° C. for 50 sec. The coating weight of the acrylamide resin compositions was 0.47–0.50 g solids/m$^2$. After drying, the samples were allowed to stand in a thermohygrostat chamber of 20° C. and 65% RH for 24 hours. The thus treated samples were subjected to the evaluation test. The test results are shown in Table 3.

COMPARATIVE USE EXAMPLES 10–15

The coating and evaluation test was carried out with the acrylamide resin compositions H–M obtained in Comparative Examples 1–6 in the same manner as in Use Examples 8–14. The coating weight of the acrylamide resin composition was 0.48–0.49 g solids/m$^2$. The test results are shown in Table 3.

COMPARATIVE USE EXAMPLE 16

The coating and evaluation test was carried out using a 6% aqueous solution of MS-3800 (oxidized starch supplied by Nihon Shokuhin Kako Co., Ltd.) in the same manner as in Use Examples 8–14. The coating weight of the oxidized starch was 1.02 g solids/m$^2$. The test results are shown in Table 3.

COMPARATIVE USE EXAMPLE 17

The coating and evaluation test was carried out using a 3% solution of PVA-117 (polyvinyl alcohol supplied by Kuraray Co., Ltd.) in the same manner as in Use Examples 8–14. The coatig weight of PVA was 0.49 g solids/m$^2$. The test results are shown in Table 3.

COMPARATIVE USE EXAMPLE 18

The coating and evaluation test was carried out using water only in the same manner as in Use Examples 8–14. The test results are shown in Table 3.

Use Examples 15–21 (Evaluation with neutral woodfree paper)

A 1.5% aqueous solution of the acrylamide resin compositions A–G obtained in Examples 1–7 was applied on both sides of neutral woodfree paper (basis weight: 84 g/m$^2$) by means of a laboratory size press (roll nip pressure: 20 kg/cm$^2$, coating speed: 100 m/min) and the coated samples were dried in a drum dryer at 80° C. for 50 sec. After drying, the samples were allowed to stand in a thermohygrostat chamber of 20° C. and 65% RH for 24 hours. Thereafter the samples were subjected to the evaluation test. The test results are shown in Table 4.

COMPARATIVE USE EXAMPLES 19–24

The coating and evaluation test was carried out using the acrylamide resin compositions H–M obtained in Comparative Examples 1–6 in the same manner as in Use Examples 15–21. The coating weight of the acrylamide resin compositions was 0.33–0.34 g solids/m$^2$. The test results are shown in Table 4.

COMPARATIVE USE EXAMPLE 25

The coating and evaluation test was carried out using a 3% solution of MS-3800 (oxidized starch supplied by Nihon Shokuhin Kako Co., Ltd.) in the same manner as in Use Examples 15–21. The coating weight of the oxidized starch was 0.68 g solids/m$^2$. The test results are shown in Table 4.

COMPARATIVE USE EXAMPLE 26

The coating and evaluation test was carried out using a 1.5% solution of PVA-117 (polyvinyl alcohol supplied by Kuraray Co., Ltd.) in the same manner as in Use Examples 15–21. The coating weight of PVA was 0.34 g solids/m$^2$. The test results are shown in Table 4.

COMPARATIVE USE EXAMPLE 27

The coating and evaluation test was carried out using water only in the same manner as in Use Examples 15–21. The test results are shown in Table 4.

Effect of the Invention

As evident from Tables 1, 2, 3 and 4, surface strength, tensile strength and internal strength of the papers, which are coated with the product of the present invention, are excellent in comparison to the papers which are coated with the conventional acrylamide resin, oxidized starch and PVA. It is revealed that the effect is especially excellent with newsprint paper and acidic woodfree paper.

What we claim is:

1. An agent for improving surface quality of paper comprising an acrylamide resin composition obtained by: polymerizing an acrylamide monomer in the presence of a urea compound, to form an acrylamide resin; and hydrolyzing the acrylamide resin with a hydrolyzing agent when the acrylamide resin is substantially polymerized wherein the amount of hydrolyzing agent is 1–40 wt % of the acrylamide monomers.

2. The agent as claimed in claim 1, wherein the ratio of the amount of the monomers to the amount of the urea compound is 95–40 wt % to 5–60 wt %.

3. The agent as claimed in claim 2, wherein said ratio is 95–60 wt % to 5–40 wt %.

4. The agent as claimed in claim 3, wherein said ratio is 95–70 wt % to 5–30 wt %.

5. An agent for improving surface quality of paper comprising an acrylamide resin composition obtained by: copolymerizing 99.5–50 mol % of an acrylamide monomer and 0.5–50 mol % of acrylonitrile monomer in the presence of a urea compound, to form an acrylamide resin, wherein the ratio of the amount of the monomers to the amount of the urea compound is 95–40 wt % to 5–60 wt %; and hydrolyzing the acrylamide resin with a hydrolyzing agent when the acrylamide resin is substantially polymerized, wherein the amount of hydrolyzing agent is 1–40 wt % of the total amount of the acrylamide monomers and the acrylonitrile monomers.

6. The agent as claimed in claim 5, wherein the acrylamide resin composition is obtained by hydrolyzing an acrylamide resin which is obtained by copolymerizing 95–70 mol % of an acrylamide monomer and 5–30 mol % of an acrylonitrile monomer in the presence of a urea compound and said ratio is 95–60 wt % to 5–40 wt %.

7. The agent as claimed in claim 6, wherein the acrylamide resin composition is obtained by hydrolyzing an acrylamide resin which is obtained by copolymerizing 95–80 mol % of an acrylamide monomer and 5–20 mol % of an acrylonitrile monomer in the presence of a urea compound and said ratio is 95–70 wt % to 5–30 wt %.

8. An agent for improving surface quality of paper comprising an acrylamide resin composition obtained by: copolymerizing an acrylamide monomer and a cross-linking agent in an amount of 0.005–5 mol % of the amount of the acrylamide monomer in the presence of a urea compound, to form an acrylamide resin, wherein the ratio of the amount of the monomers to the amount of the urea compound is 95–40 wt % to 5–6 wt %; and hydrolyzing the acrylamide resin with a hydrolyzing agent when the acrylamide resin is substantially polymerized, wherein the amount of hydrolyzing agent is 1–40 wt % of the acrylamide monomers.

9. The agent as claimed in claim 8, wherein the cross-linking agent is used in an amount of 0.01–2 mol % of the amount of acrylamide monomer and said ratio is 95–60 wt % to 5–40 wt %.

10. The agent as claimed in claim 9, wherein the cross-linking agent is used in an amount of 0.01–1 mol % of the amount of acrylamide monomer and said ratio is 95–70 wt % to 5–30 wt %.

11. An agent for improving surface quality of paper comprising an acrylamide resin composition obtained by: copolymerizing 99.5–50 mol % of an acrylamide monomer, 0.5–50 mol % of an acrylonitrile monomer and 0.005–5 mol % of the total of the acrylamide monomer and the acrylonitrile monomer of a cross-linking agent in the presence of a urea compound, to form an acrylamide resin, wherein the ratio of the amount of the monomers to the amount of the urea compound is 95–40 wt % to 5–60 wt %; and hydrolyzing the acrylamide resin with a hydrolyzing agent when the acrylamide resin is substantially polymerized, wherein the amount of hydrolyzing agent is 1–40 wt % of the total amount of the acrylamide monomers and the acrylonitrile monomers.

12. The agent as claimed in claim 11, wherein the acrylamide resin composition is obtained by hydrolyzing an acrylamide resin which is obtained by copolymerizing 95–70 mol % of an acrylamide monomer, 5–30 mol % of acrylonitrile monomer and a cross-linking agent in an amount of 0.01–2 mol % of the total of acrylamide monomer and the acrylonitrile monomer in the presence of a urea compound and said ratio is 95–60 wt % to 5–40 wt %.

13. The agent as claimed in claim 12, wherein the acrylamide resin composition is obtained by hydrolyzing an acrylamide resin which is obtained by copolymerizing 95–80 mol % of an acrylamide monomer, 5–20 mol % of acrylonitrile monomer and a cross-linking agent in an amount of 0.01–1 mol % of the total amount of acrylamide monomer and the acrylonitrile monomer in the presence of a urea compound and said ratio is 95–70 wt % to 5–30 wt %.

14. The agent as claimed in claim 1, wherein the hydrolyzing agent is selected from the group consisting of sodium hydroxide and potassium hydroxide and is present in an amount of 1–40 mol % of the total amount of the monomers.

15. The agent as claimed in claim 1, wherein the acrylamide monomer is selected from the group consisting of acrylamide, methacrylamide, N-methyl(meth)acrylamide, N-ethyl(meth)acrylamide, N,N-dimethyl(meth)acrylamide, N-isopropyl(meth)acrylamide and N-t-octyl(meth) acrylamide.

16. The agent as claimed in claim 5, wherein the acrylonitrile monomer is selected from the group consisting of acrylonitrile and methacrylonitrile.

17. The agent as claimed in claim 1, wherein the urea compound is selected from the group consisting of urea, thiourea, ethylene urea and ethylene thiourea.

18. The agent as claimed in claim 8, wherein the cross-linking agent is selected from the group consisting of methylene-bis-acrylamide, N-methylolacrylamide and 1,3, 5-triacryloylhexahydro-S-triazine.

19. The agent as claimed in claim 11, wherein the cross-linking agent is selected from the group consisting of methylene-bis-acrylamide, N-methylolacrylamide and 1,3, 5-triacryloylhexahydro-S-triazine.

* * * * *